United States Patent [19]

Demuth et al.

[11] Patent Number: 5,031,278

[45] Date of Patent: Jul. 16, 1991

[54] DEVICE FOR THE ELIMINATION OF DIRT FROM A FIBER FLEECE

[75] Inventors: Robert Demuth, Neurensdorf; Paul Stäheli, Wilen b. Wil, both of Switzerland

[73] Assignee: Maschinenfabrik Rieter AG, Winterthur, Switzerland

[21] Appl. No.: 497,618

[22] Filed: Mar. 23, 1990

[30] Foreign Application Priority Data

Mar. 23, 1989 [CH] Switzerland ..... 1092/89

[51] Int. Cl.[5] ..... D01G 15/26

[52] U.S. Cl. ..... 19/98; 19/99; 19/107; 19/112; 19/113

[58] Field of Search ..... 19/98, 99, 107, 112, 19/113

[56] References Cited

U.S. PATENT DOCUMENTS

| | | | |
|---|---|---|---|
| 2,422,011 | 6/1947 | Goldsmith, Jr. | 19/109 |
| 3,136,005 | 6/1954 | Reiterer | 19/112 |
| 3,148,415 | 9/1964 | Reiterer | 19/113 |
| 4,129,924 | 12/1978 | Wirth | 19/107 X |
| 4,224,717 | 9/1980 | Teichmann et al. | 19/98 |
| 4,271,564 | 6/1981 | Esterbanell | 19/107 X |
| 4,291,438 | 9/1981 | Seiki et al. | 19/112 |
| 4,309,796 | 1/1982 | Garrison et al. | 19/98 |
| 4,314,387 | 2/1982 | Löffler | 19/98 |
| 4,346,500 | 8/1982 | Demuth | 19/107 X |
| 4,400,852 | 8/1983 | Löffler | 19/107 X |
| 4,438,549 | 3/1984 | Silander | 19/107 |
| 4,527,307 | 7/1985 | Teichmann | 19/107 X |
| 4,642,850 | 2/1987 | Giuliani | 19/99 X |

FOREIGN PATENT DOCUMENTS

| | | | |
|---|---|---|---|
| 0250126 | 12/1987 | European Pat. Off. . | |
| 2833413 | 2/1979 | Fed. Rep. of Germany | 19/107 |
| 3127418 | 2/1983 | Fed. Rep. of Germany | 19/107 |
| 3336323 | 5/1985 | Fed. Rep. of Germany | 19/107 |
| 3821771 | 1/1989 | Fed. Rep. of Germany . | |
| 2609051 | 7/1988 | France . | |
| 45-32783 | 3/1967 | Japan | 19/107 |
| 942540 | 1/1963 | United Kingdom | 19/107 |

*Primary Examiner*—Werner H. Schroeder
*Assistant Examiner*—John J. Calvert
*Attorney, Agent, or Firm*—Burns, Doane, Swecker & Mathis

[57] ABSTRACT

A card including a main cylinder, a revolving flat as well as a licker-in roller and a doffing roller (also called a doffer roll) also includes a suction device in combination with a separating knife in order to improve the carding result and eliminate dirt in the precarding zone between the licker-in and the revolving flat, in the after carding zone between the revolving flat and the doffer roll as well as in the precarding zone between the doffer roll and the licker-in. A preparatory element has a structured surface arranged opposite to the surface of the main cylinder, in which the teeth are arranged facing the direction of rotation of the main cylinder. This structured surface allows the carding result to be retained and subjects the fleece lying on the main cylinder to a certain vibration so that, in combination with centrifugal force and the separating knife, there is better dirt separation which can be removed through the suction device. The precarding zone between the licker-in and the revolving flat can include a knife which differs from the knife in the after carding and precarding zone, in that it is not an independent element, but rather, is assigned to a card rod. With this arrangement, the carding result should be improved and the elimination of dirt on a card should also be improved. The arrangement can also be applied to all rollers carrying a fleece in which dirt must be eliminated from the fleece.

25 Claims, 5 Drawing Sheets

Fig. 1
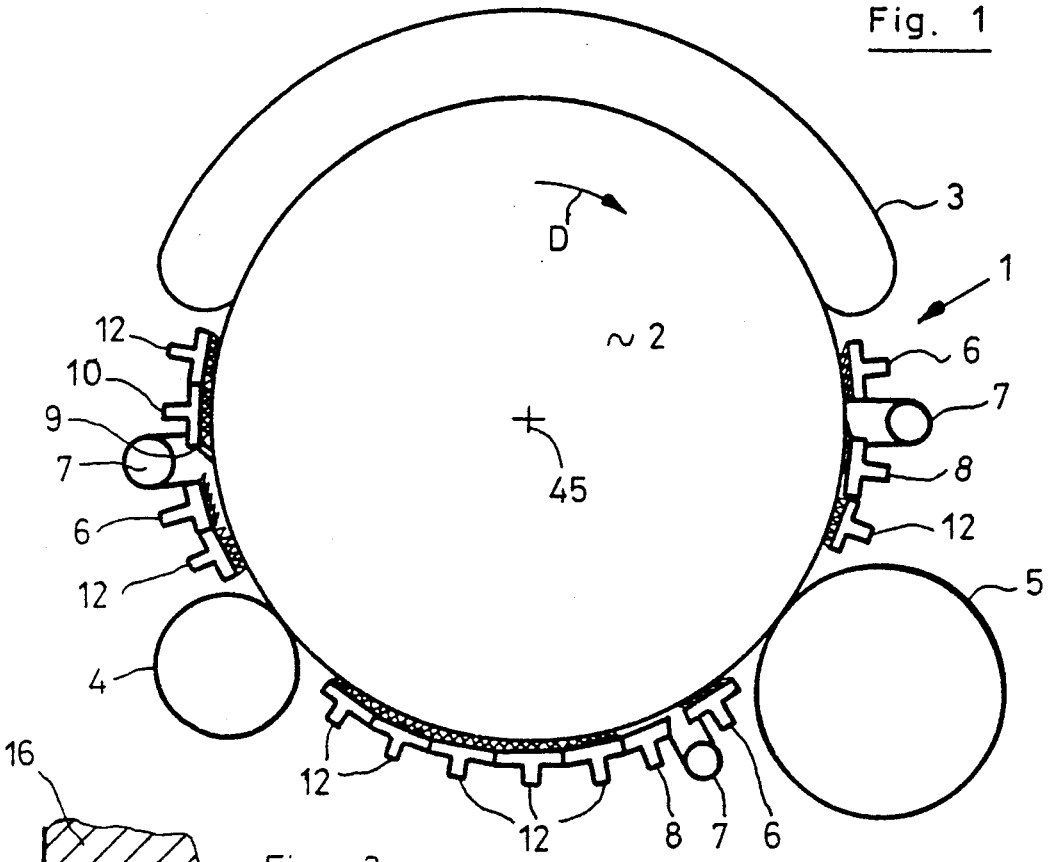
Fig. 3a
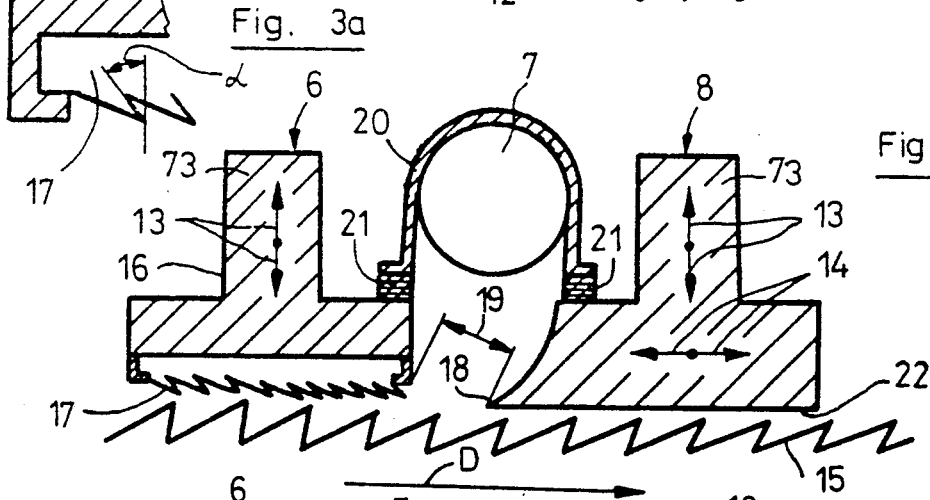
Fig. 2
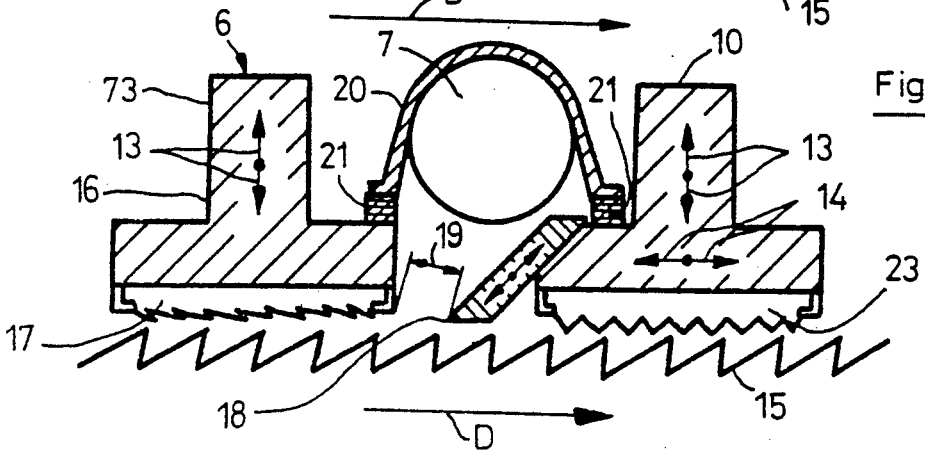
Fig. 3

DEVICE FOR THE ELIMINATION OF DIRT FROM A FIBER FLEECE

FIELD OF THE INVENTION

The invention relates to a device for the elimination of dirt from a fibre fleece rotating on a toothed roller, namely by means of a static but adjustable separation surface arranged opposite to the radial direction of the toothed roller and, seen in the direction of rotation of the toothed roller, an introduced preparatory element likewise static but adjustable in the radial direction of the toothed roller, whereby a separation gap remains free between the preparatory element and the separation surface.

BACKGROUND

In the present state of technology the devices previously mentioned are known, for example, from GB-PS 1,058,894, in which dirt is sucked out and carried away by means of a suction channel from the fleece lying on the main cylinder after the passage of the revolving flat by means of a knife arranged opposite to the direction of rotation of the main cylinder. A fleece guiding deflector is introduced to the knife, seen in the direction of rotation of the main cylinder.

An improved embodiment of the previously mentioned device for the elimination of dirt, also called briefly "dirt separator", is shown in DE-3,034,036 C2 (equivalent to U.S. Pat. No. 4,400,852) in which an additional saw toothed clothing is provided directly after the knife, in order to lay the fibre layer on the main cylinder so that the fibres are again laid parallel after they had been brought into a certain random layer by the suction.

A further dirt separator is shown in U.S. Pat. No. 4,309,796, in which the guide plate introduced to the knife is subsequently arranged seen in the direction of rotation of the main cylinder and a static carding element is provided directly after the knife. The whole is shown in a carding machine in which only static carding elements are used and a dirt separator previously mentioned is provided between these static elements, respectively.

A similar embodiment is shown in DE-2,846,109 C3 (equivalent to U.S. Pat. No. 4,314,387) in which, likewise after a static carding element, (seen in the direction of rotation of the main cylinder) a guide plate is provided opposite to the surface of the main cylinder as well as a knife which forms a specified separation gap and which is fastened on the subsequent static carding element.

Thereby the guide surface is part of a collecting rail which is adjustable away from and against the main cylinder surface, as also applies to the guide knife.

Moreover, the latter elements are still adjustable in such a way that the clearance of the separation gap between the edge of the knife and the collecting rail is alterable.

The general disadvantage of the previously mentioned state of technology can be observed in the opening room and card room from the viewpoint of the development of the throughput performance of modern machines, in that the performance in these areas has considerably increased in latter years.

In particular, not only higher throughput performances are demanded from the cards, but also an improved carded sliver, so that development work must be undertaken in the systematics of the individual carding functions in order to obtain a more even carded sliver with higher performance, which, moreover, has less neps, dirt content and less damage to the fibers.

In the previously mentioned state of technology it can be established without exception that the inventors at this stage of technological development were of the opinion that, before reaching the edge of the knife previously mentioned, the fibre fleece lying on the main cylinder must be guided through a smooth guide surface, in order to obtain good results. This consideration emanated from the experience that a dirt separator gap between two static card elements without the guide surface previously mentioned shows a so-called "snout" in the separation gap which had the disadvantage that this snout, if uncontrolled, could reach either the suction or the fleece. This "snout-effect" could be eliminated with the previously mentioned guide plate introduced to the knife.

In the high performances demanded from such a card at the present time, it is, however, necessary not to have any surfaces on the main cylinder which do not have a carding function, if possible.

For this reason, the task is to find a substitute for the previously mentioned guide plate which has at least a positive carding result without the so-called snout effect.

Experiments have now surprisingly shown that a card rod turned through 180°, which is inserted instead of the previously mentioned guide surface, still gave a good carding result whilst guiding the fibres to the knife without the appearance of a snout.

For this reason, the invention solving this problem goes therefore, in the direction that the state of technology previously mentioned has attached the criterion that the preparatory element should have a structured surface opposite to the periphery of the toothed roller.

SUMMARY OF THE INVENTION

In accordance with the invention, a device is provided for the separation of dirt from a fibre fleece on a rotating toothed roller. The device includes a separation knife arranged opposite to a direction of rotation of the toothed roller so that it is static but adjustable in the radial direction of the toothed roller. A preparatory element upstream of the separation knife with respect to the direction of rotation of the toothed roller is also static but adjustable in the radial direction of the toothed roller. A separation gap remains free between the preparatory element and the separation knife and the preparatory element has a structured surface opposite to the periphery of the toothed roller.

In accordance with a preferred embodiment of the invention, the separation gap is covered by a suction channel. Also, the preparatory element can be a card rod with the structured surface of the card rod being formed by an all steel clothing with teeth arranged in the direction of movement of the periphery of the toothed roller. The all steel clothing can have a front rake of 0° to 75°. The structured surface can be a fish scale surface with the fish scales arranged in the direction of movement of the periphery of the toothed roller or the structured surface can be a ribbed surface, the ribs of which are transverse to the direction of movement of the periphery of the toothed roller and which extend over the whole length of the card rod. The structured surface can also be a knurled surface or an undulating surface with undulations arranged transversely to the direction of movement of the periphery of the toothed roller and which extend over the whole surface of the card rod. Alternatively, the structured surface can be provided with rows of neighboring dimples which cover the entire surface or the structured surface can be covered with wart like protuberances.

In another preferred embodiment, the structured surface can be formed by an orifice plate and the card rod can have a hollow space, the orifice plate covering the hollow space of the card rod on a side facing the periphery of the toothed roller. The orifice plate can have a specified number of holes which connect the hollow space with the surroundings of the structured surface and the diameter of the holes can be between 0.3 mm and 1.5 mm. The hollow space can be connected to an underpressure source or an excess pressure source and a pulsator can be provided between the pressure sources and the hollow space to permit the air in the hollow space to pulsate.

The preparatory element can be arranged to be adjustable in the radial direction of the toothed roller and the separating knife can be arranged to be adjustable in the radial direction of the toothed roller. The card rod can be provided subsequent to the knife, seen in the direction of movement of the toothed roller, whereby on the one hand the card rod is adjustable in the radial direction of the toothed roller and on the other hand, the knife can be adjusted on the card rod in such a way that the knife edge can be adjusted towards or away from the periphery of the toothed roller. The preparatory element can also be adjustable in the peripheral direction of the toothed roller in order to alter the opening of the separation gap.

The advantages achieved through the invention lie in the fact that with the optimal layout of the card for carding results, it is possible to separate dirt optimally at the same time.

BRIEF DESCRIPTION OF THE DRAWINGS

The invention is explained in more detail with reference to the accompanying drawings, in which:

FIG. 1 shows a transverse section through a card, limited to a representation only of those parts which refer to the invention, schematically represented;

FIG. 2 shows an enlarged representation of the section of the card from FIG. 1;

FIG. 3 shows a variant of the device of FIG. 2;

FIG. 3*a* shows an enlargement of part of the device shown in FIG. 2;

DETAILED DESCRIPTION OF THE PREFERRED EMBODIMENT

Figure 4:
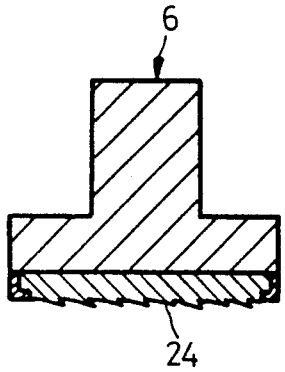
FIGS. 4–6, 8, 9, 11 and 13 each show a variant of an element shown in FIG. 2.

FIG. 1 shows schematically the transverse section of a card 1 with a main cylinder 2, a revolving flat 3 arranged above, a licker-in 4 and a doffer roll 5. The elements in front of the licker-in and after the doffer roll are not shown for the sake of simplicity.

In the after carding zone between the revolving flat 3 and the doffer roll 5 as well as in the precarding zone between the doffer roll 5 and the licker-in 4, a preparatory element 6, a suction device 7 and a separating knife 8 are provided respectively one after each other, seen in the direction of rotation D of the main cylinder. This combination corresponds with the combination shown in FIG. 2.

In the precarding zone between the licker-in 4 and the revolving flat 3 a combination is provided according to FIG. 3, namely, in sequence, a preparatory element 6, a suction device 7 and a separating knife 9. Thereby the separating knife is arranged to be adjustable on a carding element 10 in the direction of the arrow 11.

In the precarding zone there is a carding element 12 arranged in front of the preparatory element 6 and after the carding element 10, whilst in the after carding zone and in the precarding zone carding elements 12 are provided after the separating knife 8, namely one in the after carding zone and five in the precarding zone.

Thereby, with the carding elements 12, this is a matter of the same carding elements as the carding elements 10, however, without the separating knife 9.

The manner in which the elements 6, 8, 10 and 12 are fastened is explained later with the aid of FIG. 17. It should only be pointed out in the interim that the elements 6, 8, 10 and 12, respectively, are arranged to be adjustable in the direction of the arrow 13, that is, these elements are installed to be adjustable, in the radial direction against and away from the main cylinder 2.

Figure 17:
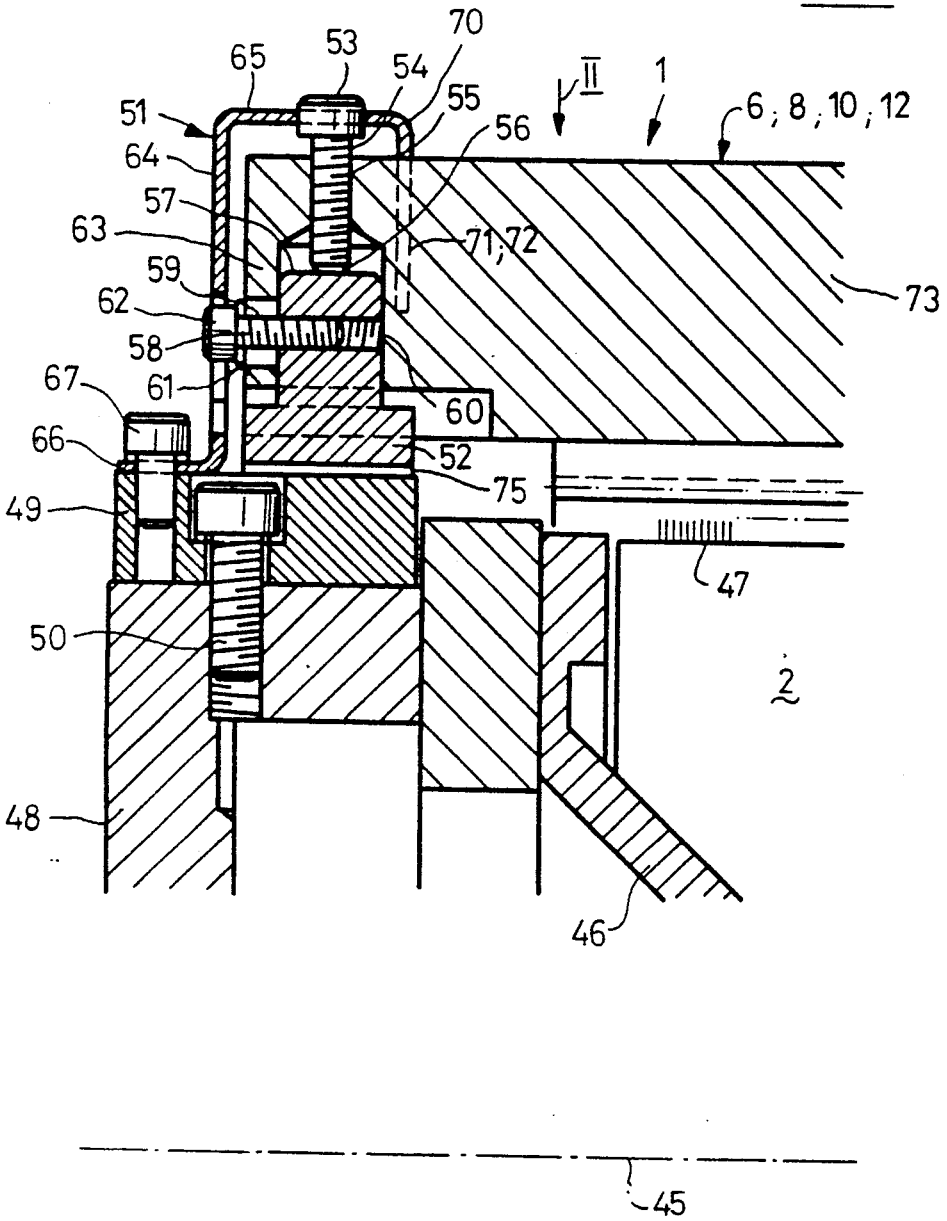
FIG. 17 shows an embodiment for adjusting the elements of FIGS. 1–16.
Figure 18:
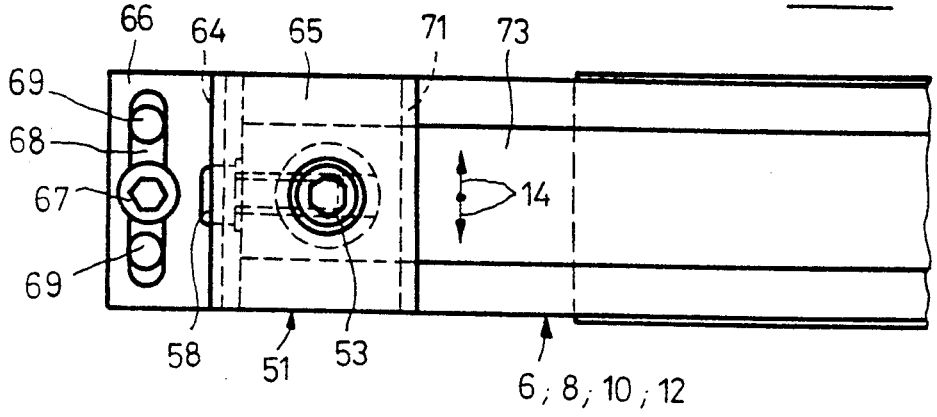
FIG. 18 shows a topview of part of FIG. 17, according to the direction of the arrow II.

Further, the elements 8 and 10 are also adjustable in the direction of the arrow 14, and likewise explained and shown with the aid of FIGS. 17 and 18.

Moreover, in FIGS. 2 and 3, there is in addition an all steel clothing 15 belonging to the main cylinder 2, drawn on to the surface of this, which is schematically represented.

The preparatory element 6 consists of a carrier body 16 arranged together with an all steel clothing 17. The manner in which such all steel clothing is arranged on such carrier bodies 16 is well known from the state of technology, for example from the Swiss patent specification 543 607, and is therefore not further described.

The inventive idea of the all steel clothing 17 of the preparatory element 6 lies in the fact that the teeth of this clothing are arranged with edges thereof facing substantially in the direction of movement D of the main cylinder and that the front rake alpha ($\alpha$) (see FIG. 3*a*) is in the range from 0 to 75 degrees. Thereby, the term front rake is defined in the DIN Standard Sheet No. 64 123/ Sheet 1.

The separating knife 8 has a similar form to the carrier body 16 of the preparatory element 6 but it has, however, a cutting edge 18 directed against the direction of movement D of the main cylinder 2 and a smooth bottom face 22.

A separation gap 19 remains open between the cutting edge 18 and the all steel clothing 17.

The dirt separated through this cutting gap 19 is taken up from the suction device 7 and conveyed to a filter (not shown).

The suction device 7 consists of a U-shaped channel 20, described later, which lies on the preparatory element 6 and on the separating knife 8, respectively, by means of foam rubber gaskets 21, without exercising any force in the actual sense. Thereby, the foam rubber can be glued to the channel 20.

FIG. 3 shows partly the same elements as FIG. 2 which is the reason why the same elements are designated with the same reference symbols and are not described once more.

FIG. 3 shows an advantageous embodiment over FIG. 2 insofar as instead of the separating knife 8, a relatively smaller separating knife 9 is provided on the carding element 10. Instead of the bottom face 22 of the separating knife 8, a card clothing 23 (also called an all steel clothing) can be provided so that the length of the bottom face 22 (seen in the direction of movement D) can substantially be used for carding. This all steel clothing 23 is a normal card clothing, that is, it does not have a type of tooth as the steel clothing 17. The functions of the card clothing are known and are not further described for this reason.

The manner of fastening the separation knife 9 on the carding element 10 is not shown further. It can, however, either be held firmly to the carding element 10 or be movable and locked in position in the direction of movement 11 by means of a guide slot and screws fitted to it, which are anchored in the carding element 10.

For operation, the preparatory element 6 and the carding element 10 must each be adjustable separately in the direction of movement 13, 14 respectively. This adjustment is not impeded by the foam rubber gasket 21 of the suction device 7, as the adjustment is kept within a very small range.

Figure 5:
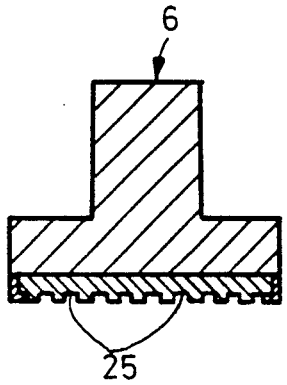
Figure 8:
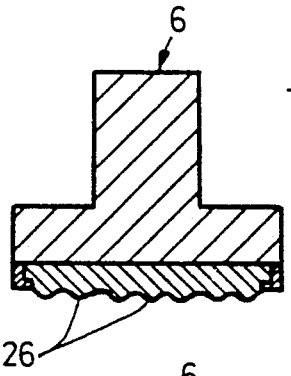

FIGS. 4, 5 and 8 each show a preparatory element 6, having an alternative to the all steel clothing 17. For example, FIG. 4 shows the structured surface as fish scales 24 having edges thereof facing the direction of rotation of the main cylinder instead of the all steel clothing 17, whilst FIG. 5 shows longitudinal ribs 25 and FIG. 8 shows longitudinal undulations 26.

The terms "longitudinal ribs" or "longitudinal undulations" are understood to mean those ribs or undulations, respectively, stretching over the entire length of the preparatory elements 6 so that they correspond at least in their length to the width of the main cylinder 2, or its clothing, respectively, which for the specialist is taken to refer to the width of the main cylinder.

The technical and technological function of the all steel clothing 17, the fish scales 24, the ribs 25 and undulations 26, respectively, as well as the further variants, still to be described in the following, consist of setting the unevenness of the fleece lying on the all steel clothing 15 of the main cylinder in vibration, in order to bring the particles of dirt better to the surface with the aid of centrifugal force, which also works on the particles of dirt in the fleece, in order to separate them on the knife edge 18 and remove them by means of the suction device 17.

Moreover, a positive carding result still exists even though reduced, when compared with normal card clothing.

Figure 6:
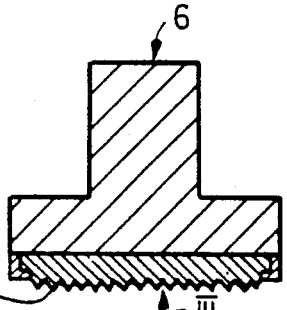
Figure 7:
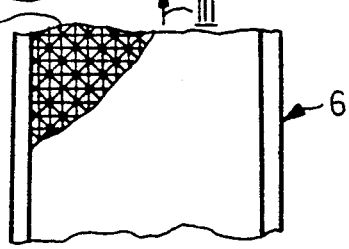
FIGS. 7, 10 and 12 each show a view of FIGS. 6, 9, 11, respectively, from a direction III.
Figure 9:
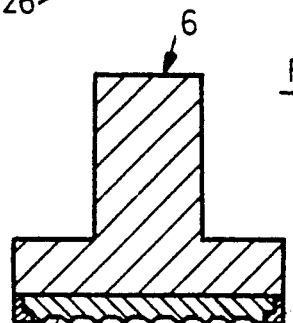
Figure 10:
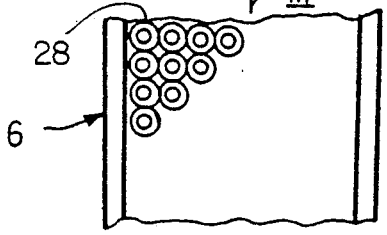
Figure 13:
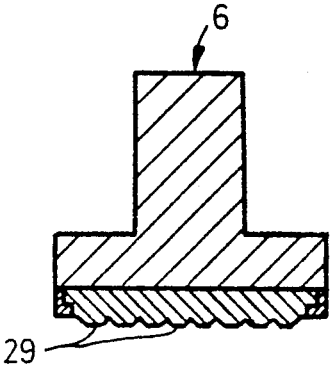

As further variants for the fulfillment of the technical and technological purposes, FIGS. 6 and 7 show instead of the all steel clothing 17, a knurled surface 27, whilst FIGS. 9 and 10 are provided with crater shaped depressions 28 and FIG. 13 with wart-like protuberances 29.

Figure 11:
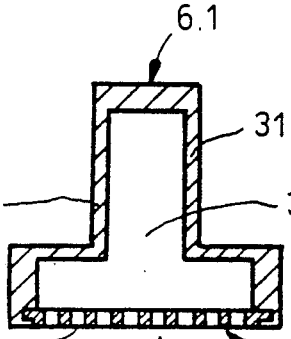
Figure 12:
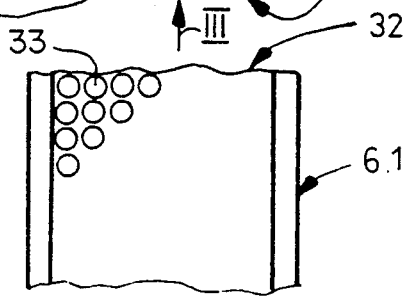

FIGS. 11 and 12 show a further step in the realization of the inventive idea, in that the preparatory element 6.1 is provided with a hollow space 30, which has a connecting opening 31 and an orifice plate 32 on one side.

The dimensions of the teeth of the all steel clothing 17, of the fish scales 24, of the ribs 25, the undulations 26, of the knurling 27, the dimples or depressions 28 and protuberances 29, respectively, and of the hole diameter and number of holes 33 of the orifice plate 32 are to be determined by experiments and are not further explained here. As a guiding principle, a hole diameter between 0.3 and 1.5 mm can be used.

Figure 14:
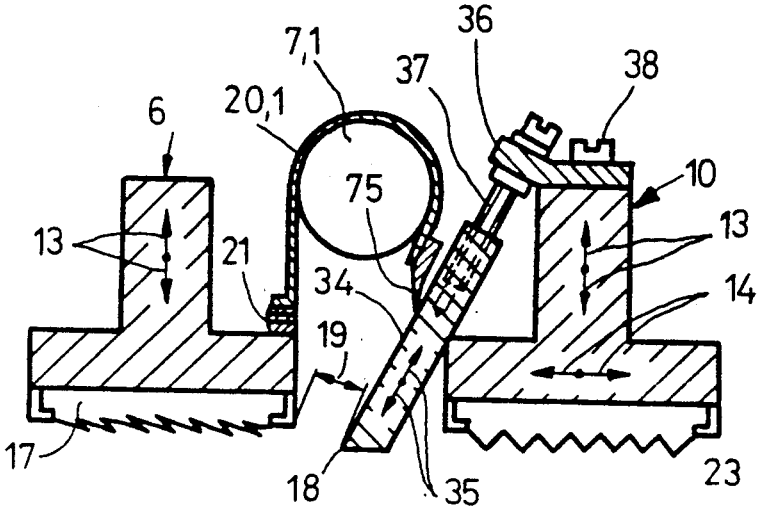
FIG. 14 shows a variant of the device of FIG. 3.

FIG. 14 shows a variant of the device from FIG. 3 in that a knife 34 is arranged on the carding element 10 and in the direction of movement 35 is arranged so that it can be movable or be locked in position.

The movement or locked setting of the knife 34 is effected with the aid of an adjusting screw 37, which is connected with the knife 34 by means of its screw thread, rotating in a support 36 but which, however, is locked in position against axial displacement.

The support 36 is rigidly connected with the carding element 10 with screws 38.

The suction device 7.1 includes a channel 20.1 and has the same function as the suction device 7 which includes the channel 20. The latter is, however, sealed against the atmosphere in the area of the knife 34 by means of a lip seal 75 adjacent to the knife 34 and firmly glued to the channel 20, 20.1.

Regarding the independent movement of the knife 34, relative to the mobility of the carding element 10 and relative to the mobility of the preparatory element 6, what has already been said for the suction device 7 still applies, namely that the movements are very small and are not affected by the seals 21 and 75.

Figure 15:
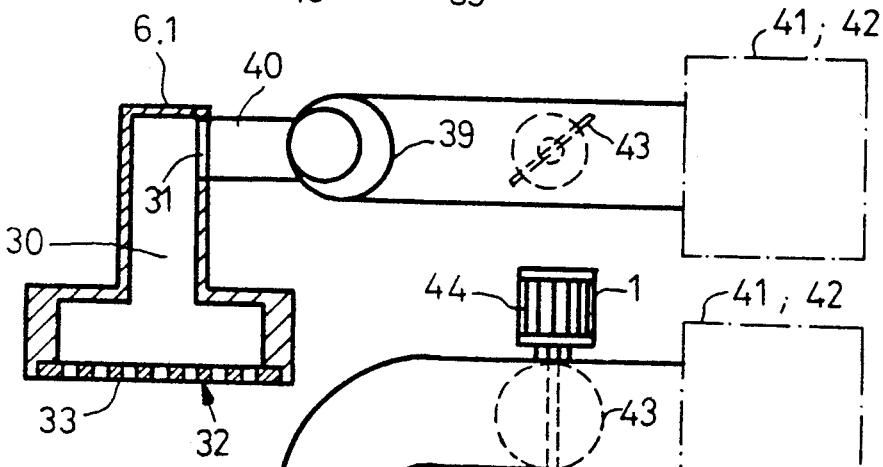
FIG. 15 shows an application of the element of FIG. 11 in a cross section taken along the arrow I of FIG. 16.
Figure 16:
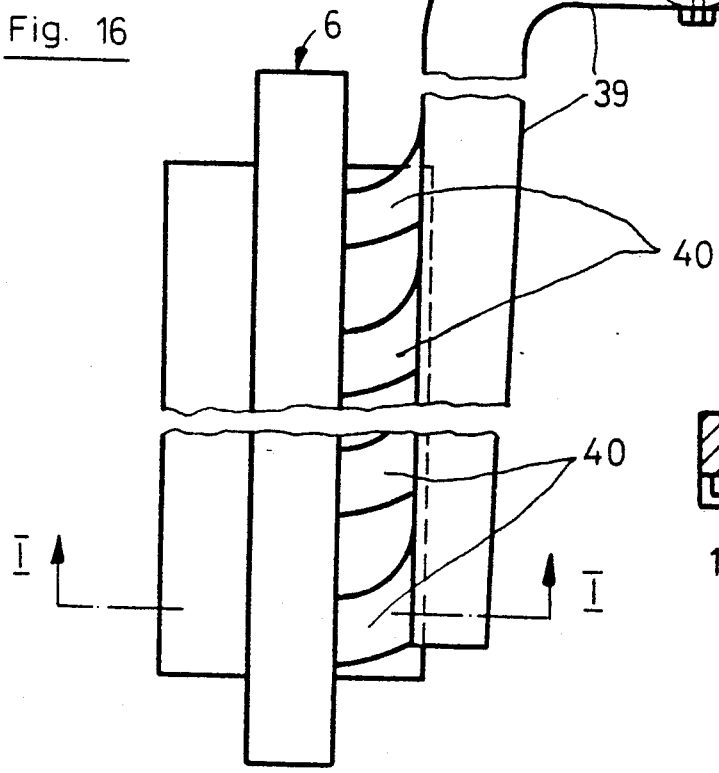
FIG. 16 shows a topview of FIG. 15.

FIGS. 15 and 16 show an application of the preparatory element 6.1 from FIGS. 11 and 12 with a plurality of connection openings 31, all of which are connected with an air collection pipe 39 over the connection supports 40.

The air collection pipe on its part is connected either with an excess pressure air source 41 or with an underpressure source 42.

Further, the air collection pipe 39 is provided with a rotating shut off flap 43 which is connected with the driving shaft of a driving motor 44.

The function of this rotating shut off flap 43 consists of the production of an under pressure or excess pressure air stream in the air collection pipe. It is only used when this pulsating air has an application.

The shut off flap 43 can remain in the open position if the occasion arises when the pulsating air is not in use.

The function of the pulsating air, whether it is underpressure or excess pressure, consists of the vibration of the fleece lying on the clothing of the main cylinder 15, as already explained, before this reaches the knife edge 18 of the knife edges of the knives 9 or 34, respectively.

Whichever of the two processes is used, whether it is underpressure or excess pressure, depends on the technological requirements on the card and can be decided from case to case.

The term "air collection pipe" is in itself not really descriptive of an underpressure operation, as in such cases it acts more as an air distribution pipe. For the sake of simplicity, the same term is used for both types of processes.

FIG. 17 corresponds substantially to FIG. 1 of German Patent Application DE-3,811,679.0 which is mentioned in order to show the anchoring of the elements 6, 8, 10 and 12 with regard to mobility in the radial direction of movement 13. Details of this anchoring arrangement are also shown in copending and commonly owned U.S. patent application Ser. No. 07/424,505 filed on Oct. 20, 1989, the disclosure of which is hereby incorporated by reference.

FIG. 18 does not correspond to the previously mentioned German patent application, but rather, is an additional variant of that application, in order to arrange that the elements 8 and 10 so as to also be movable in the peripheral direction 14. FIG. 17 shows some details of the card 1, in order to explain the adjustable fastening of the elements 6, 8, 10 and 12.

As can be seen from FIGS. 1 and 17, there is a card 1 consisting of a main cylinder 2, which is pivotable on an axis 45 so that it can be driven, a casing 46, which covers the front ends of the main cylinder, whereby only the left part of the casing on the left front face of the main cylinder in FIG. 17 is visible. Movable elements in the radial direction of the main cylinder surround the card and, as already explained, these are the preparatory element 6, the knife 8 or the carding element 10 as well as the carding element 12. All of these elements can, for example, be fastened so that they are adjustable in the way shown with the aid of the FIG. 17. It should be understood that the invention is not restricted to this type of fastening.

The revolving flat 3 additionally shown in FIG. 1, the licker-in 4, and the doffer roll 5 are not important to the present invention and are not further described for this reason.

The main cylinder 2 carries an all steel clothing 47 in the customary manner.

The elements 6, 8, 10, and 12 are formed on the ends in the same way, which is the reason why they can all be fastened in the way shown in FIG. 17. This manner of fastening is described more closely in the following:

As shown in FIG. 17, the casing 46 has a rigidly arranged flange 48, which is a component part of the casing and extends as an annulus around the axis 45 of the main cylinder. A fastening block 49 is fastened to the flange 48 by screws 50 extending in the radial direction. Each of the elements 6, 8, 10 or 12 is held against the fastening block 49 by means of a spring clip 51. The support of the two ends of the elements 6, 8, 10 or 12, is effected over the fastening block 49 and an adjustment block 52, the upper part of which is led into a guide extending in the radial direction in the ends of the elements 6, 8, 10 or 12. There is an adjusting screw 53 with a screw thread 54 above the adjustment block 52, which works in conjunction with the corresponding screw thread 55 in the end of the cover. The end 56 of the adjusting screw 53 opposite to the manipulating head engages with the radial outer flange 57 of the adjustment block 52 and in this way supports the end of the elements 6, 8, 10 or 12, whereby the desired radial clearance to the spiked clothing of the main cylinder can be set by turning the screw 53.

A clamping screw 58 extends at a right angle to the adjustment screw 53, that is, parallel to the axis of the main cylinder and engages with its thread 59 in a corresponding internal thread 60 in the adjusting block 52. A washer 61 is located below the operating head 62 of the clamping screw 58, so that this is drawn against the outer wall part 63 of the end of one of the elements 6, 8, 10 and 12 and tightened with the clamping screw 58 of the adjusting block 52. Through this, the set clearance of the clothing 17, 23 or of their alternatives 24, 25, 26, 27, 28, 29 is fixed.

The spring clip 51 has a first limb 64 and a second limb 65 bent from a spring steel strip, whereby the limb 65 forms an angle of 80° with the first limb. The first limb 64 has an angled part 66 which is fastened to the fastening block 49 via a screw 67. The angled part 66 of the spring clip also has a slot 68 (FIG. 18) which is provided for fitting guide pins 69 in order to determine the correct position of the spring clip on the fastening block 49 against twisting in the peripheral direction of the main cylinder.

On the other hand, when the screw is slack, this slot permits the spring clip 51 and therewith the appropriate ends of the elements 6, 8, 10 and 12 to move in the direction of movement 14 (FIGS. 2, 3 and 18), in order to alter the width of the opening of the separation gap 19.

The second limb 65 likewise has an angled part 70 on the end opposite to the first limb, which is fork shaped. The two dovetails 71, 72 (only one of which is shown in FIG..17) of the fork shaped part 70 extend along both sides of a stiffening rib 73 of the elements 6, 8, 10 or 12, shown in the installed state in FIG. 17, whereby the edge 74 of the fork shaped opening presses on the upper side of the stiffening rib 73.

Figure 19:
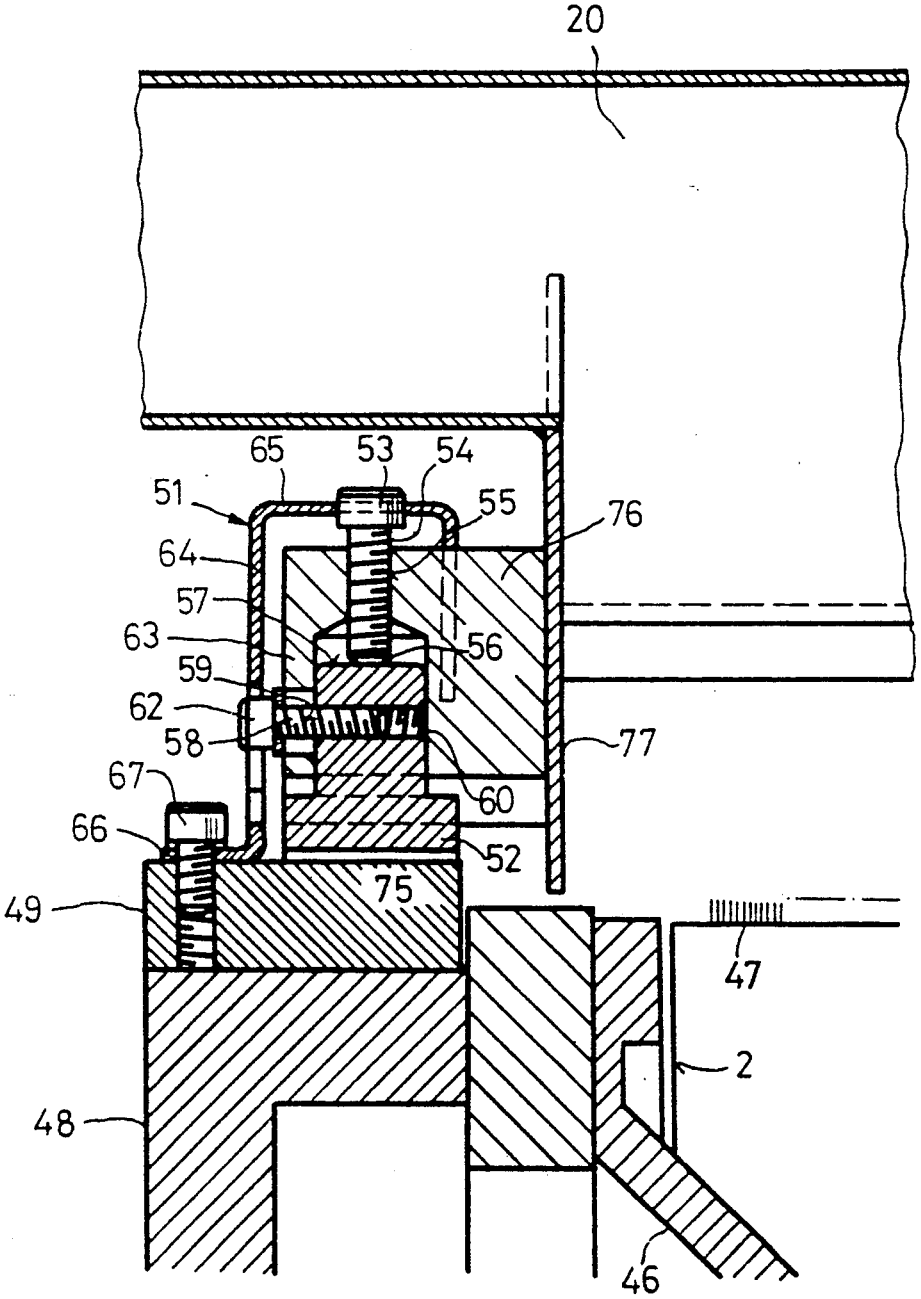
FIG. 19 shows a detail of FIGS. 2, 3 and 14 in section and in an enlarged representation.

FIG. 19 shows the fastening system of FIG. 17, however, for the fastening of the U-shaped channel 20. For this purpose a connecting piece 76 is arranged rigidly on a front end closing wall 77 of the channel 20, the cross section of which corresponds to the cross section of the stiffening rib 73.

Figure 20:
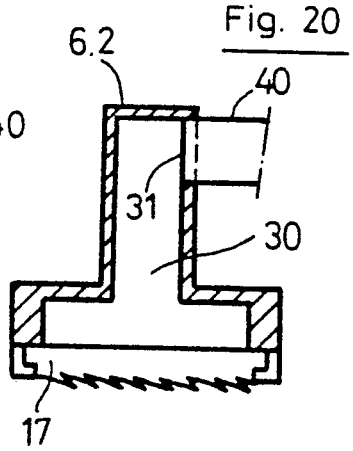
FIG. 20 shows a variant of an element of FIG. 2.

Reference is also made to DE-3,811,679 for the system from FIGS. 17 and 20. It can be likewise explained that the system used on both ends of the elements 6, 8, 10, 12 or the channel 20 is a mirror image.

It should however be explained that the application of the inventive idea is not restricted to the type of the adjustment and fastening of the elements 6, 8, 10 or 12 shown in FIG. 17 and FIG. 19. Other types of fastening and adjustment, which permit a movement of the elements in the directions 13, 14, respectively, should be regarded as equivalents.

Moreover, it is shown in FIG. 20 that the elements 6 in FIGS. 2 to 10 and 13 can be combined with element 6.1 as element 6.2 which has a hollow space and can be used with the system according to FIGS. 15 and 16. For this purpose holes (not shown) must be provided for the passage of air between the individual items of all the steel clothing 17 or in the ribs 25 or in the wave troughs or undulations 26 or in the craters 28, respectively, adjacent to the dimpling or protuberances 29 or in the troughs of the knurled surface 27. Thereby, the number and diameter of the holes must be determined through experiments.

Finally, it should be explained that the invention is not restricted to the application in a card, rather, it can likewise be used on all rollers which carry a fleece from which dirt must be eliminated.

What is claimed is:

1. A device for the separation of dirt from a fibre fleece on a rotating toothed roller, comprising:

a separation knife included in a direction opposite to a direction of rotation of the toothed roller, the knife being static but adjustable toward and away from the toothed roller;

a preparatory element upstream of the separation knife with respect to the direction of rotation of the toothed roller, the preparatory element being static but adjustable toward and away from the toothed roller independently of the separation knife;

a separation gap between the preparatory element and the separation knife; and the preparatory element having a structured surface facing an outer periphery of the toothed roller, the structured surface comprising means for providing a positive carding result by inducing a vibrating effect on the fiber fleece lying on the rotating toothed roller and bringing particles of dirt to the exposed surface of the fleece.

2. The device according to claim 1, wherein the separation gap is covered by a suction channel.

3. The device according to claim 1, wherein the preparatory element is a card rod.

4. The device according to claim 1, wherein the preparatory element comprises a card rod and the structured surface of the card rod comprises an all steel clothing with teeth thereon having edges facing downstream with respect to the direction of rotation of the periphery of the toothed roller.

5. The device according to claim 4, wherein the all steel clothing has a front rake of 0° to 75°.

6. The device according to claim 3, wherein the structured surface is a fish scale surface, the fish scales having edges facing in the direction of rotation of the periphery of the toothed roller.

7. The device according to claim 3, wherein the structured surface is a ribbed surface, the ribs of which are transverse to the direction of rotation of the periphery of the toothed roller and which extend over the whole length of the card rod.

8. The device according to claim 3, wherein the structured surface is a knurled surface.

9. The device according to claim 3, wherein the structured surface is an undulating surface having undulations arranged transversely to the direction of rotation of the periphery of the toothed roller and the undulations covering an entire surface of the card rod.

10. The device according to claim 3, wherein the structured surface is provided with rows of neighboring dimples covering an entire surface of the card rod.

11. The device according to claim 3, wherein the structured surface is a surface covered with wart like protuberances.

12. The device according to claim 3, wherein the structured surface comprises an orifice plate.

13. The device according to claim 3, wherein the card rod has a hollow space in fluid communication with the structured surface.

14. The device according to claim 12, wherein the orifice plate covers a hollow space in the card rod and the orifice plate is located between the hollow space and the periphery of the toothed roller.

15. The device according to claim 13, wherein the structured surface is provided with a specified number of holes which connect the hollow space with air surrounding the structured surface.

16. The device according to claim 13, wherein the hollow space is connected to an underpressure source.

17. The device according to claim 13, wherein the hollow space is connected to an excess pressure source.

18. The device according to claim 1, wherein a card rod is provided downstream of the knife with respect to the direction of rotation of the toothed roller, the card rod being adjustable in the radial direction of the toothed roller and the knife being adjustable on the card rod in such a way that a knife edge of the knife can be adjusted towards or away from the periphery of the toothed roller.

19. The device according to claim 1, wherein the preparatory element is adjustable in a peripheral direction of the toothed roller in order to alter a size of the separation gap.

20. A device for the separation of dirt from a fibre fleece on a rotating toothed roller, comprising:

a separation knife inclined in a direction opposite to a direction of rotation of the toothed roller, the knife being static but adjustable toward and away from the toothed roller;

a preparatory element upstream of the separation knife with respect to the direction of rotation of the toothed roller, the preparatory element being static but adjustable toward and away from the toothed roller;

a separation gap between the preparatory element and the separation knife; and the preparatory element having a structured surface facing an outer periphery of the toothed roller, the preparatory element comprising a card rod, the structured surface being formed by an orifice plate having holes therein, each of the holes having a diameter between 0.3 mm and 1.5 mm.

21. A device for the separation of dirt from a fibre fleece on a rotating toothed roller, comprising:

a separation knife included in a direction opposite to a direction of rotation of the toothed roller, the knife being static but adjustable toward and away from the toothed roller;

a preparatory element upstream of the separation knife with respect to the direction of rotation of the toothed roller, the preparatory element being static but adjustable toward and away from the toothed roller;

a separation gap between the preparatory element and the separation knife; and the preparatory element having a structured surface facing an outer periphery of the toothed roller, the preparatory element comprising a card rod, the structured surface being formed by an orifice plate having holes therein, the orifice plate covering a hollow space in the card rod and being located between the hollow space and the periphery of the toothed roller, each of the holes having a diameter between 0.5 mm and 1.5 mm.

22. A device for the separation of dirt from a fibre fleece on a rotating toothed roller, comprising:

a separation knife included in a direction opposite to a direction of rotation of the toothed roller, the knife being static but adjustable toward and away from the toothed roller;

a preparatory element upstream of the separation knife with respect to the direction of rotation of the toothed roller, the preparatory element being static but adjustable toward and away from the toothed roller;

a separation gap between the preparatory element and the separation knife; and the preparatory element having a structured surface facing an outer periphery of the toothed roller, the preparatory element comprising a card rod having a hollow space therein, the structured surface being provided with a specified number of holes which connect the hollow space with air surrounding the structured surface, each of the holes having a diameter between 0.3 mm and 1.5 mm.

23. A device for the separation of dirt from a fibre fleece on a rotating toothed roller, comprising:

a separation knife inclined in a direction opposite to a direction of rotation of the toothed roller, the knife being static but adjustable toward and away from the toothed roller;

a preparatory element upstream of the separation knife with respect to the direction of rotation of the toothed roller, the preparatory element being static but adjustable toward and away from the toothed roller;

a separation gap between the preparatory element and the separation knife; and the preparatory element having a structured surface facing an outer periphery of the toothed roller, the preparatory element comprising a card rod having a hollow space therein in fluid communication with the structured surface, the hollow space being connected to an underpressure source, and a pulsator being provided between the underpressure source and the hollow space which permits air in the hollow space to pulsate.

24. A device for the separation of dirt from a fibre fleece on a rotating toothed roller, comprising:

a separation knife inclined in a direction opposite to a direction of rotation of the toothed roller, the knife being static but adjustable toward and away from the toothed roller;

a preparatory element upstream of the separation knife with respect to the direction of rotation of the toothed roller, the preparatory element being static but adjustable toward and away from the toothed roller;

a separation gap between the preparatory element and the separation knife; and the preparatory element having a structured surface facing an outer periphery of the toothed roller, the preparatory element comprising a card rod having a hollow space therein in fluid communication with the structured surface, the hollow space being connected to an excess pressure source, and a pulsator being provided between the excess pressure source and the hollow space which permits air in the hollow space to pulsate.

25. A device for the separation of dirt from a fibre fleece on a rotating toothed roller, comprising:

a separation knife inclined in a direction opposite to a direction of rotation of the toothed roller, the knife being static but adjustable toward and away from the toothed roller;

a preparatory element upstream of the separation knife with respect to the direction of rotation of the toothed roller, the preparatory element being static but adjustable toward and away from the toothed roller;

a separation gap between the preparatory element and the separation knife; and the preparatory element having a structured surface facing an outer periphery of the toothed roller, the structured surface comprising means for providing a positive carding result by inducing a vibrating effect on the fibre fleece lying on the rotating toothed roller and bringing particles of dirt to the exposed surface of the fleece, the separation gap being covered by suction channel means for applying a suction force to the separation gap and the preparatory element comprising a card rod, the structured surface comprising a steel clothing with teeth thereon having edges facing downstream with respect to the direction of rotation of the toothed roller.

* * * * *